United States Patent [19]

Bennett et al.

[11] 4,444,062

[45] Apr. 24, 1984

[54] LIQUID TRANSFER DEVICE

[76] Inventors: John T. Bennett, 10087 Tyler Pl., Ijamsville, Md. 21754; Jack E. Goodman, 24141 Kings Valley Rd., Germantown, Md. 20874

[21] Appl. No.: 375,161

[22] Filed: May 5, 1982

[51] Int. Cl.[3] ..... B01L 3/02

[52] U.S. Cl. ..... 73/863.32; 73/864.11; 422/100

[58] Field of Search ..... 73/863.32, 864.11; 422/100

[56] References Cited

U.S. PATENT DOCUMENTS 2,152,105 4/1939 Szecsi ..... 73/864.11

3,650,306 3/1972 Lancaster ..... 422/100

*Primary Examiner*—S. Clement Swisher

*Attorney, Agent, or Firm*—Sughrue, Mion, Zinn, Macpeak and Seas

[57] ABSTRACT

The liquid transfer device includes a hand-held housing having a plunger mounted for sliding movement therein with a plurality of rods on one end thereof. The plunger is located within a recess in the housing with the rods normally protruding outside the recess when the plunger is located fully within the recess. A barrel assembly is detachably connected to the housing and is provided with a plurality of through passages that are in equal number to the number of rods. An elastic diaphragm or membrane is secured between the housing and the barrel assembly over the rods so that the membrane is stretched into the individual through passages by means of the rod so that the ends of the through passages adjacent the housing are sealed by the membrane. Upon depression of the plunger, the rods extend further into the through passages by stretching the elastic membrane and upon releasing the plunger the elastic membranes act as a return spring for the plunger and rods to draw fluid into the passages from a suitable source for a subsequent deposit in individual test receptacles.

7 Claims, 5 Drawing Figures

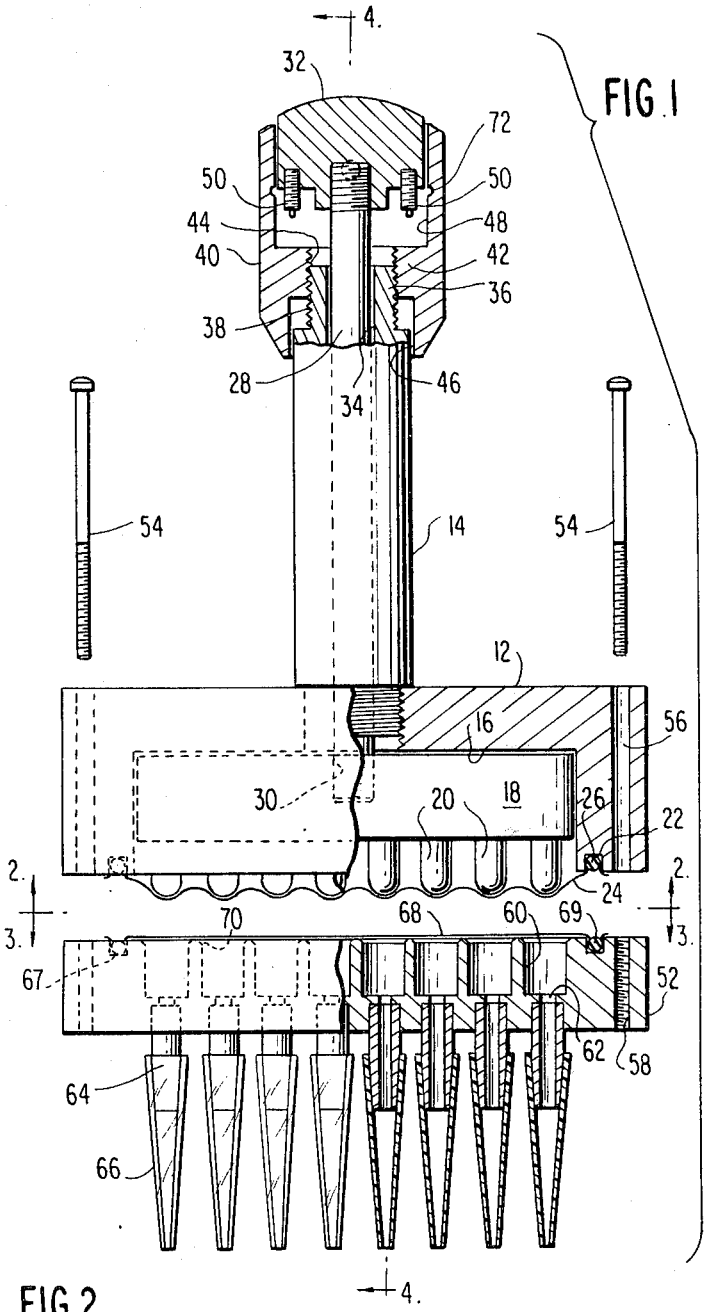
FIG. 1
FIG. 2
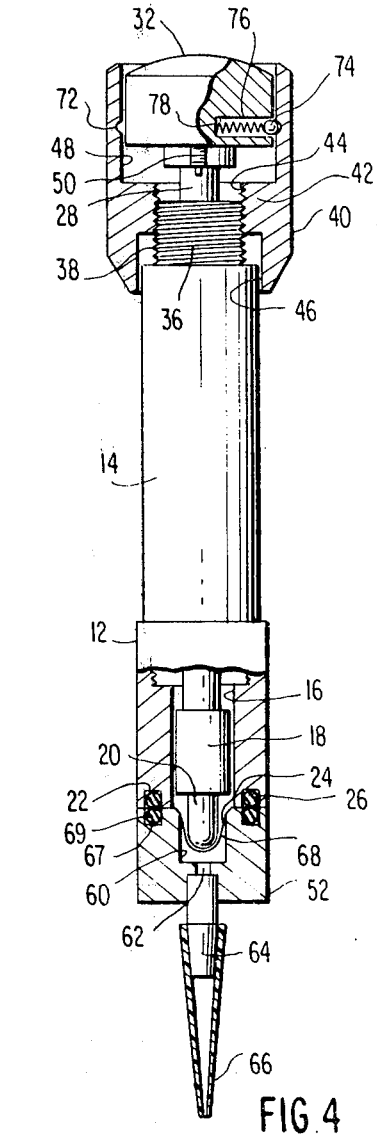
FIG. 4
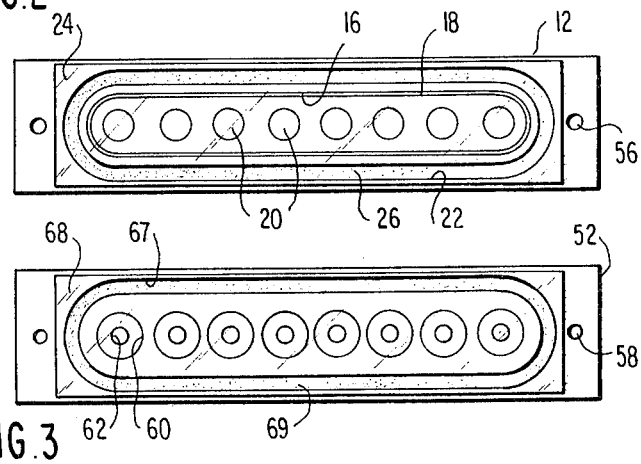
FIG. 3
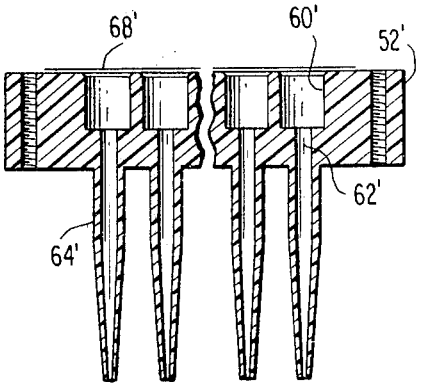
FIG. 5

LIQUID TRANSFER DEVICE

BACKGROUND OF THE INVENTION

The present invention is directed to a hand-held multiple channel liquid transfer device and more specifically to a multiple channel transfer device utilizing a plurality of plungers in combination with an elastic diaphragm adapted to be stretched by the plungers into each channel.

Many tests and applications in the medical field require picking up predetermined amounts of liquid reagents from one container and injecting or depositing the same into another recepticle or container as a daily or routine bench procedure. An example of such a test is one performed in a multi-well micro tube tray where a culturing/rehydrating medium is added to a dried prepared micro-tube tray to perform an antibiotic sensitivity test or bacterial identification. Another example is in hybridoma screening and cloning where the same type of multi-well plate containing cells has to be fed with fresh growth media periodically and/or, when determined, the cells themselves are transferred to another plate or receptacle for further studies.

In the past pins or prongs such as disclosed in the U.S. Pat. No. 2,956,931 to Goldberg or loops as disclosed in the U.S. Pat. No. 4,115,200 to Anderson were used for picking up small drops by surface tension and depositing them in another solution. The amount of liquid transferred by such means is generally limited and such means basically carry out a mixing operation because they take out the same volume they put in. The risk of contamination is high if not sterilized between uses due to the contact of the prong or loop with the various mixtures in the containers. These drawbacks can be overcome by a positive displacement device such as a syringe. However, syringes generally require the use of O-rings or other close tolerance type seals which provide resistant to movement making them hard to operate when grouped into a multi-channel battery. Furthermore, the use of syringes in a multi-channel hand-held transfer device are apt to be trouble prone, easily contaminated, expensive or bulky.

The U.S. Pat. No. 3,982,438 to Byrd discloses a multiple sample pipetting apparatus wherein a plurality of small tubes extend downwardly with the upper end portions communicating with reservoirs that have a predetermined volume. A flexible diaphragm extends across all of the reservoirs and the upper ends thereof are in communication with a common manifold chamber. The application of positive or negative pressure moves the diaphragm downwardly and upwardly into contact with the lower and upper reservoir walls respectively to either extract or expel liquid from the tubes. The accuracy of the amounts of liquid extracted or expelled by the tubes is dependent upon the pressure in the manifold chamber and the volume thereof and does not rely upon the use of reciprocating plungers.

The U.S. Pat. No. 3,568,735 to Lancaster discloses a laboratory microtritation dispensing apparatus comprising a manifold connected to a plurality of passageways, a head member connected to the manifold and having a plurality of apertures aligned with the passageways but separated therefrom by a flexible diaphragm, an actuator mounted in each aperture including a piston normally biased by a spring to maintain the flexible diaphragm means out of its respective one of said apertures and a dispensing needle connected to each actuator assembly whereby upon supplying and exhausting air to and from the manifold, the diaphragm will be moved by the differential pressure on opposite sides thereof to operate the pistons in the respective apertures to control the pickup and discharge of fluid by the needles. Thus, Lancaster utilizes air pressure in the manifold for controlling the transfer of liquids as does the patent to Byrd.

The U.S. Pat. No. 4,047,438 to Sekine discloses a liquid quantitative dispensing apparatus for withdrawing liquid into a plurality of pipettes arranged in rows by simultaneously pressing and releasing cap-like projections formed of flexible material and dispensing the liquid to test tubes and the like. The cap-like projections of flexible material are disposed in alignment with a plurality of pipettes and extend upwardly into bores in a guide plate. A plurality of plungers secured to a common plate are operative within the bores for pressing on the cap-like projections to dispense the liquid from the pipettes. In this patent, as well as the two previously mentioned patents, it is extremely difficult to provide a good seal for the membrane since the membrane is being clamped between two flat surfaces.

SUMMARY OF THE INVENTION

The present invention provides a new and improved liquid transfer device having a unique plunger and diaphragm arrangement in a hand-held multi-channel environment which provides for greater sensitivity and accuracy in operation as well as providing a unique sterile barrier.

The present invention provides a new and improved liquid transfer device having a plunger mounted for sliding movement within a hand-held housing, a plurality of rods projecting from said plunger, a barrel section having a plurality of through-passages formed therein equal in number to the number of said rods, means for detachably connecting said barrel means to said housing and elastic diaphragm means adapted to be secured intermediate said housing and barrel means whereby said rods will press said diaphragm into said passages when said barrel means is connected to said housing. The diaphragm can be connected either to the housing over the ends of said rods or may be connected to the barrel means over the passages and the entire barrel means may be formed of plastic material for disposal after a single use. In the disposable form the diaphragm may be of relatively thin material since it does not have to be heavy enough to withstand repeated uses.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is an exploded side elevation view showing a first embodiment of the liquid transfer device according to the present invention.

FIG. 2 is an end view of the plunger and housing assembly as viewed in the direction of the arrows 2—2 in FIG. 1.

FIG. 3 is an end view of the barrel assembly as viewed in the direction of the arrows 3—3 in FiG. 1.

FIG. 4 is a sectional view taken along the line 4—4 in FIG. 1 with the device assembled and the plunger depressed.

FIG. 5 is a view of a disposable barrel assembly according to a second embodiment of the present invention.

DETAILED DESCRIPTION OF THE INVENTION

The liquid transfer device 10 shown in FIG. 1 is comprised of a rectilinear housing 12 having a hollow handle 14 threaded into an aperture in the upper surface of the housing 12. The housing is provided with a downwardly opening recess 16 adapted to receive a plunger 18 having a similar configuration. A plurality of downwardly projecting rods 20 having rounded tips are secured to the plunger 18 by any suitable means. The plunger and the housing may be constructed of aluminum and rods 20 may be constructed of brass and may be press fitted into apertures in the plunger 18. According to the present disclosure, eight rods 20 are provided in a single row but it is conceivable that a larger or smaller number of rods may be provided on the plunger. A groove 22 is also provided in the lower surface of the housing 12 and completely surrounds the recess 16. An elastic rubber membrane 24 of latex completely overlies the recess 16 and the ends of the rods protruding therefrom and the periphery of the membrane is secured in the groove 22 by means of an endless O-ring 26 having dimensions suitable for press fitting the O-ring into the groove 22.

Since the ends of the rods 20 protrude beyond the opening of the recess 16 when the plunger 18 is in engagement with the bottom of the recess 16 the elastic membrane 24 will be stretched by engagement with the rounded ends of the rods 20 to place the membrane under tension in the vicinity of each rod. The membrane also acts as a spring means for retaining the plunger 18 within the recess 16. A piston rod 28 is threaded into a suitable aperture 30 in the upper surface of the plunger 18 and a cylindrical operating piston 32 is threaded on the opposite end of the piston rod 28. The piston rod 28 extends through a central passage 34 in the handle 14. The handle 14 is provided with a reduced diameter boss 36 on the upper end thereof having external threads 38 formed thereon. A hollow tubular sleeve 40 is provided with a radially inwardly projecting annular boss 42 having internal threads 44 disposed in meshing engagement with the threads 38 on the boss 36. The sleeve 40 is provided with a first cylindrical bore 46 on one side of the annular boss 42 having a diameter slightly larger than the diameter of the handle 14 and a second cylindrical bore 48 having an internal diameter slightly larger than the diameter of the piston 32. A pair of adjustable screw threaded stop members 50 are threaded into the bottom of the piston 32 for engagement with the annular boss 42 upon depression of the piston 32. By adjusting the position of the annular boss 42 by means of the threaded engagement thereof with the threaded boss on the handle 14, the downward movement of the piston 32 can be adjustably controlled.

A barrel member 52 having a rectilinear configuration complimentary to the rectilinear configuration of the housing 12 is adapted to be secured thereto by means of screws 54 which extend through threaded apertures 56 and 58 in the housing 12 and barrel member 52 respectively. The barrel member 52 is provided with a plurality of wells 60 in the upper surface thereof equal in number to the number of rods 20 and disposed in alignment with the rods 20 when the barrel member 52 is secured to the housing 12. Only one well 60 has been shown in FIG. 1 since all of the other wells disposed in a row along the width of the barrel member 52 are identical. A passage 62 communicates the bottom of each well with the lower surface of the barrel member 52 and a plurality of hollow, downwardly tapering rods 64 are press fitted into said passages 62 in the bottom of the barrel member 52. Disposable plastic extensions 66 may be press fitted on the hollow tapered tubes 64 for holding predetermined volumes of a liquid. Only one plastic extension 66 has been shown. The barrel member 52 may be made of aluminum and the hollow tubular extension 64 may be made of brass or the like. A shallow groove is formed in the upper surface of the barrel member 52 which completely surrounds the row of wells 60. A thin plastic diaphragm 68 of any suitable plastic material having a limited degree of elasticity is stretched over the top of the wells 60 and secured in the groove 67 by means of an elastic O-ring 69 pressed into the groove 67. The groove 67 is in alignment with the grooves 22 in the housing 12 when the barrel member 52 is secured to the housing 12.

When the barrel member 52 is secured to the housing 12 the rods 20 will extend into each well 60 and the stretched elastic membrane 24 will engage the peripheral edges of each well through the diaphragm 68 to form a complete seal about the upper edge of each well so as to prevent cross-contamination between the wells during a liquid transfer operation. The upper edge of each well 60 is beveled at 70 to prevent undue wear on the diaphragm 68 and the membrane 24. The diaphragm 68 is provided over the wells primarily to protect the wells from contamination when the barrel member is detached from the housing. Provided suitable sterile conditions are provided, it is conceivable that the diaphragm 68 could be eliminated and therefore, the elastic member 24 would contact the beveled edges 70 of each well directly.

In operation, the barrel member 52 is secured to the housing 12 by means of the screws 54 and hollow tubular plastic extensions 66 are secured to each of the hollow tubes 64. Depending upon the amount of liquid that is to be transferred, the sleeve 42 may be threaded upwardly or downwardly on the boss 36 of the handle 14. Suitable indicia may be provided on the handle and the sleeve in order to indicate the amount of fluid that will be picked up depending upon the adjustment of the sleeve relative to the handle. The sleeve is provided with an annular internal groove 72 and a ball 74 is located in a recess 76 in the piston 32. The ball 74 is biased outwardly by means of a spring 78 for engagement in the groove 72.

When a technician grasps the handle 14 the piston 32 is suitably positioned for operation by the thumb on the same hand so that the entire transfer operation can be conducted by one hand leaving the other hand free for other tasks. In order to pick up a predetermined amount of liquid the piston 32 is depressed until the ball 74 engages the groove 72 thereby indicating that the rods 20 have been depressed a sufficient distance into the wells 60 to draw up the proper amount of liquid from a liquid supply in suitable receptacle or receptacles into which the tips of the plastic extensions are immersed 66. The piston 32 is then released and the elastic force of the membrane 24 causes the rods 20, plunger 18, piston rod 28 and piston 32 to move upwardly to bring the plunger 18 into engagement with the bottom of the recess 16. Since the elastic membrane 24 is maintained in engagement around the edge of each well 60 during this operation, a negative pressure would be created within each well 60 thereby drawing a predetermined amount of liquid upwardly into the plastic extensions 66. The liquid transfer device is then positioned to place the tips of the extensions 66 in suitable receptacles into which the liquid is to be discharged and the piston 32 is again depressed until the ball 74 engages the groove 72. The downward movement of the rods 20 should be sufficient to expel the liquid from the plastic members 66 and to ensure a complete discharge of the liquid, the piston 32 is pressed further downwardly until the ends of the stops 50 engage the annular boss 42. The plastic extensions 66 can then be removed from the tubes 64 and discarded and new plastic extensions 66 placed on the tubes 64 for a subsequent liquid transfer operation.

According to a second embodiment of the present invention the entire barrel assembly including the barrel member 52', the hollow tubes 64' and the extensions can all be molded from plastic in a single piece. In lieu of the plastic diaphragm 68, an elastic membrane 68' could then be secured to the upper surface of the barrel member 52' by any suitable means such as heat sealing or a groove and O-ring connection similar to that described with respect to the first embodiment. Thus, the entire barrel assembly could be discarded after each liquid transfer operation to eliminate the necessity of putting on and taking off the individual plastic extension members 66. With the elastic membrane 68' secured to the barrel member 52 it is no longer necessary to have an elastic membrane on the housing over the tips of the rods 20. Upon securement of the housing to the barrel member 52', the rods 20 will extend into the wells 60' a sufficient distance to tension the elastic membrane 68' and bring the elastic membrane into sealing engagement with the edge of each well. According to this embodiment where the entire barrel assembly is disposable, suitable quick disconnected means can be provided for detachably connecting the barrel assembly to the housing. The operation of the device according to the second embodiment is then substantially identical to the operation of the device according to the first embodiment.

While the invention has been particularly shown and described with reference to preferred embodiments thereof, it will be understood by those in the art that the foregoing and other changes in form and details may be made therein without departing from the spirit and scope of the invention.

We claim:

1. A liquid transfer device comprising housing means having a downwardly open recess, plunger means located within said recess and having at least one downwardly projecting rod adapted to extend outwardly of the recess when said plunger means is in engagement with the bottom of said recess, barrel means detachably secured to said housing means and having at least one upwardly open well therein disposed in alignment with said rod and downwardly opening passage means in communication with said well and an elastic membrane secured between said housing means and said barrel means under tension whereby when said barrel means is connected to said housing means, said rod will extend said membrane into said well in sealing engagement therewith and means for moving said rod further into said well against the elastic force of said membrane.

2. A liquid transfer device as set forth in claim 1, wherein said membrane is secured to the undersurface of said housing means and extends over the entire recess therein.

3. A liquid transfer device as set forth in claim 1, wherein said elastic membrane is secured to said barrel means and is adapted to extend over the entire recess in said housing means when said barrel means is secured to said housing means.

4. A liquid transfer device as set forth in claims 2 or 3, wherein a plurality of rods are secured to said plunger means and extend equidistantly downwardly therefrom and a plurality of wells are formed in the upper surface of said barrel means equal in number to the number of rods and in alignment with said rods whereby the rods will force the elastic membrane into each well into sealing engagement with the upper peripheral edge of each well to prevent cross-contamination between said wells.

5. A liquid transfer device as set forth in claim 4, wherein said means for moving said plunger means against the elastic force of said spring is comprised of piston means secured to said plunger means and extending upwardly through an aperture in said housing means and further comprising adjustable stop means secured to said housing means for limiting the downward movement of said piston means.

6. A liquid transfer device as set forth in claim 5, further comprising detent means operatively disposed between said piston means and said adjustable stop means for determining an intermediate stop position between the fully retracted position of the plunger means and the fully extended position of said plunger means.

7. A liquid transfer device as set forth in claim 2 further comprising an elastic diaphragm secured to said barrel means in overlying relation with respect to each well in said barrel means to protect each well from contamination when said barrel means is detached from said housing.

* * * * *